United States Patent [19]

Malacheski et al.

[11] 4,173,292

[45] Nov. 6, 1979

[54] VALVED CLOSURE FOR A PRESSURE VESSEL

[76] Inventors: Joseph J. Malacheski; Richard J. Zenda, both of 32 Warner St., both of Plains, Pa. 18705

[21] Appl. No.: 941,294

[22] Filed: Sep. 11, 1978

Related U.S. Application Data

[63] Continuation-in-part of Ser. No. 901,474, May 1, 1978, Pat. No. 4,147,273.

[51] Int. Cl.[2] ..... B65D 51/16

[52] U.S. Cl. ..... 220/303; 220/206; 220/DIG. 32

[58] Field of Search ..... 220/303, 304, 202, 203, 220/204, 206, DIG. 32

[56] References Cited

U.S. PATENT DOCUMENTS

| | | | |
|---|---|---|---|
| 3,186,580 | 6/1965 | Previte | 220/206 |
| 3,373,894 | 3/1968 | Johnson | 220/303 X |
| 3,434,621 | 3/1969 | Previte | 220/206 |
| 3,587,912 | 4/1969 | Ohta | 220/206 X |
| 3,878,965 | 4/1975 | Crute | 220/303 X |

*Primary Examiner*—George T. Hall

*Attorney, Agent, or Firm*—Robert K. Youtie

[57] ABSTRACT

A valved closure for a pressure vessel having an upstanding filling neck with a side opening and a retaining flange, a cap-like adaptor in sealing engagement with the neck and removably retained in interfitting relation with the flange, and open insert in sealing relation within the adaptor and extending spacedly into the neck to sealingly engage the vessel top wall and combine with the neck to define an annular chamber, a rotary valve element seated on the insert and resiliently urged toward sealing engagement therewith, and one-way inlet and outlet valves for passing fluid at predetermined pressures in one direction from the vessel outwardly through the neck side passageway and in the other direction through the neck side passageway into the vessel.

9 Claims, 3 Drawing Figures

VALVED CLOSURE FOR A PRESSURE VESSEL

CROSS-REFERENCES TO RELATED APPLICATIONS

This application is a continuation-in-part of our prior co-pending patent application Serial No. 901,474 filed May 1, 1978; now Pat. No. 4,147,273.

BACKGROUND OF THE INVENTION

While the valved closure of the present invention has been primarily developed for use in automotive radiators, and will be illustrated and described with particular reference thereto, it is appreciated that the device is capable of versatility in use in other environments and applications, all of which are intended to be comprehended herein.

In the technological area of valved closures for pressure vessels, such as automotive radiators, there exist certain problems, including the hazard of burned skin to one removing the cap of a hot radiator, the difficulty in removal and replacement of conventional caps even in the absence of hot fluid, as well as the constant likelihood of non-replacement, loss, and the like.

Other problems existing in current automotive radiator closures involve desired release of pressurized fluid at normal engine operating temperatures and collection of the fluid exteriorly of the radiator for return of the fluid to the radiator upon non-use and cooling of the engine. Such coolant overflow recovery systems have been lacking in reliability, so that expensive coolant is frequently lost with consequent engine overheating.

SUMMARY OF THE INVENTION

It is, therefore, among the important objects of the present invention to cure the above-mentioned difficulties in the prior art, eliminate or minimize the danger of being burned by hot radiator fluid, greatly facilitate the opening and closing of automotive radiators while preventing misplacement and loss of radiator caps, and greatly enhance the reliability of coolant overflow recovery and reuse, all of which is achieved by an extremely simple structure adapted for manufacture and sale at a modest price.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Referring now more particularly to the drawings, a valved radiator closure is there generally designated 10, and includes a generally circular or annular adaptor 11 and a valve element 12 rotatable on the adaptor.

Figure 3:
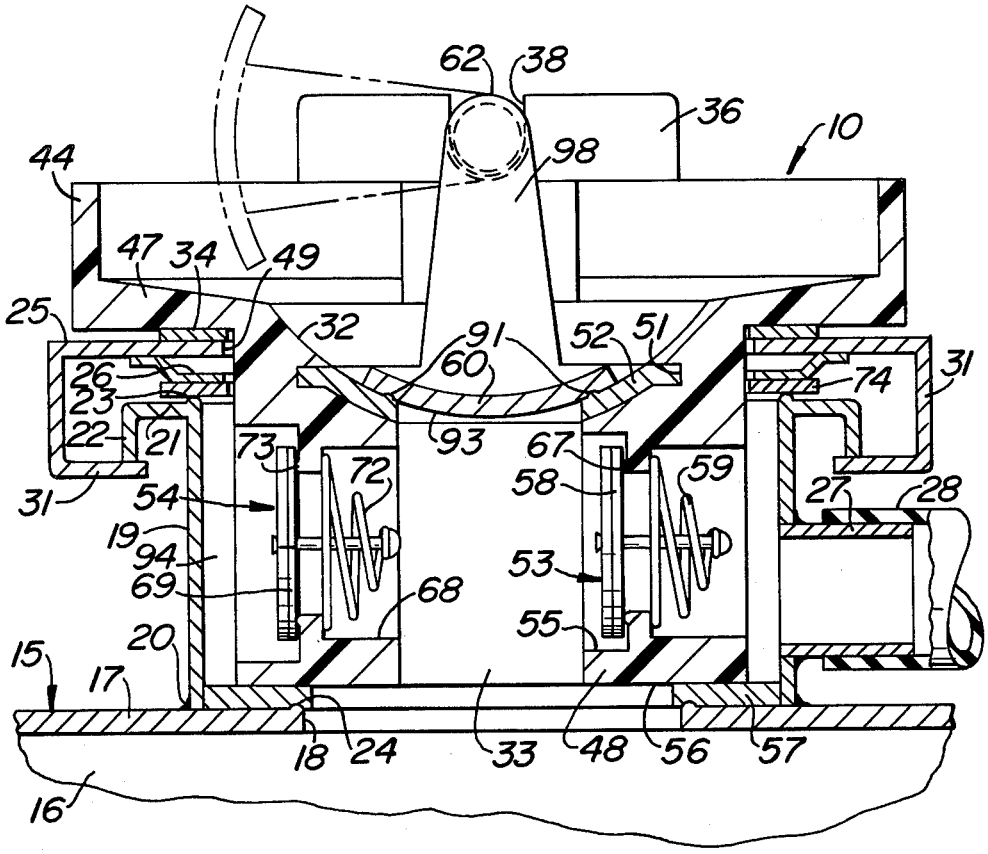
FIG. 3 is a vertical sectional view taken generally along the line 3—3 of FIG. 2. and illustrating the valved closure in operative association with a pressure vessel, being in a closed position in solid lines and an open position in phantom.

As best seen in FIG. 3, a conventional heat exchanger, radiator, or other pressure vessel is generally designated 15, and may have an upper radiator fluid chamber 16 having an upper wall 17. The upper or top vessel wall 17 may have a through opening 18 provided circumferentially about its upper or outer side with a sealing bead 24. Upstanding from the vessel top wall 17, concentric with and spaced circumferentially about the through hole or opening 18 is a tubular spout or filler neck 19, being suitably secured to the vessel wall 17, as by circumferential welding or brazing 20. The filler neck or tube 19 is provided about its upper end with a circumferentially extending outstanding flange 21, which may include a depending lip 22. The upper side of flange 21 may be circumferentially raised to define a sealing rib or bead 23. Intermediate the lower and upper ends of filler neck 19 there may be provided an ingress and egress side opening or nipple 27, provided with a conduit 28, as for back and forth passage therethrough of recovery coolant. The radiator and filler neck thus far described may be generally conventional.

The adaptor 11 may include a generally annular, substantially circular plate or member 25 adapted to be concentrically superposed over the upper end of filler neck 19. Further, the adaptor ring or annulus 25 may be provided on its under side with a resilient sealing flange or lip 26 for sealing engagement with the upper rib or bead 23 of filler neck 19.

At spaced locations about the adaptor ring 25, say diametrically opposed locations, there may be formed a pair of depending, inturned retainer formations, fingers or clips 31 for engagement beneath the depending flange lip 22 to secure the adaptor 11 in position on the neck 19 with the adaptor sealing flange 26 in resilient sealing engagement with the next sealing bead 23. This structure may be similar to that found in presently existing radiator caps, the depending lip 22 having declining lower edges, or other suitable means, to insure effective sealing engagement between the flange 26 and bead 23.

Upstanding from the outer edge of adaptor ring 25, at opposite sides thereof, say between retainer clips 31, may be a pair of upstanding arcuate walls or protective shields 35 and 36. The upstanding walls 35 and 36 may be generally concentric with the adaptor ring 25, being diametrically opposed with respect to each other, and each formed with an upwardly opening guide or cutout, as at 37 and 38, respectively. The guide notches 37 and 38 are in diametric alignment with each other with respect to the adaptor 11 and may be of generally U-shaped, upwardly open configuration, as illustrated. In addition, below each guide cutout or notch 37 and 38, the respective wall 35 and 36 is formed with a half-moon cut, as at 39 and 40 in FIG. 1, the material thereof being struck outwardly therefrom to define respective outstanding ledges or shelves 41 and 42. This structure may be essentially identical to that described in said co-pending patent application; and further, the adaptor ring 25 may be provided adjacent to and inwardly of each guide notch or cutout 39 and 40 with a struck up hook, as in said co-pending patent application.

While the adaptor 25 may be conveniently placed on and removed from the fill neck 19 in generally the same manner as a conventional radiator cap, it will become apparent hereinafter that frequent removal of the adaptor of the instant invention is not necessary, as in the case of prior art radiator caps.

A centrally open, generally annular insert 46 is engaged concentrically within the adaptor ring 25. The insert 46 may include a circumferential portion 47 resting on the adaptor ring entirely thereabout, and including an upstanding peripheral wall 44 extending about the periphery of portion 47, and having a pair of diametrically opposed, indented or inwardly recessed portions 43 and 45 respectively located adjacent to and spaced radially inwardly from guide notches 37 and 38. In addition, insert 46 is provided with a depending tubular portion 48 having its upper end generally funnel-shaped, as at 32 and converging downwardly into a central, open-ended through bore or hole 33 which faces toward and opens into the vessel top wall 17.

The circumferential insert portion 47 is superposed over the adaptor 25 and seated on a sealing gasket 34 which is interposed between the under side of insert portion 47 and the adaptor ring. The tubular depending portion 48 of insert 46 depends downwardly through the gasket 34 and central opening or hole 49 of the adaptor ring. The convergent or funnel surface 32 may be formed with an internal annular groove 51, in which is engaged an annular valve seat 52 for a purpose appearing presently.

The lower end of depending, tubular portion 48, as at 56, terminates over and spaced from the top wall 17, and particularly over the sealing bead 24. Interposed between the lower end 56 of depending insert portion 48 and the sealing bead 24 is a relatively compressible sealing ring or washer 57.

The wall of cylindrical depending insert portion 48 may be provided at spaced locations therethrough, with a pair of resiliently biased, oppositely directed, one-way ingress and egress valves, as at 53 and 54, respectively. The ingress or inlet valve 53 is located in a through wall opening 55 of insert portion 48, and includes a valve element 58 resiliently biased by suitable means, such as spring 59 toward a closed position, as illustrated, in sealing engagement with a valve seat 67. Thus, under a predetermined fluid pressure exerted radially inwardly through passageway 55 against one-way inlet valve element 58, the latter is displaced away from valve seat 67 to open the latter and pass fluid inwardly into central passageway 33.

The one-way outlet valve 54 is mounted in a generally radial passageway 68 through the wall of insert portion 48, and includes a valve element 69 facing radially outwardly from the depending insert portion 48 and resiliently yieldably retained by a coil compression spring 72 in closed sealing engagement with a valve seat 73. Internal pressure from the vessel chamber 16 communicated to the central hollow 33 of depending insert portion 48 will, at a predetermined threshold pressure, open valve 54 to discharge fluid exteriorly about the insert portion 48.

It will now be appreciated that the depending insert portion 48 enters into spaced relation within the neck 19, having its lower end sealed against vessel wall 17 by a gasket 57. The upper end of the insert portion 48 is sealed against adaptor 25 by gasket 34; and, an additional gasket 74 may be interposed between the resilient flange or lip 26 and bead 25 to effectively seal the same. Thus, there is defined a generally annular sealed space or chamber 94 which communicates through valve 53 to pass fluid and through valve 54 to receive fluid. Also, annular sealed chamber 94 communicates through passageway 27 to a recovery or collection container (not shown).

The valve element 12 may be constituted of a generally circular body or disc 60 illustrated in solid line position concentrically over the adaptor 11. The valve element or disc 60 may have a generally spherical convex surface or valve face 93 best seen in FIG. 3 and there illustrated in solid lines in sealing engagement with the upper concave surface of gasket 52. The upper concave surface of gasket 52 may be generally spherical in curvature, and extend in flush relation with the downwardly convergent, spherically curved surface of funnel 32. The centers of curvature of valve element surface 93, valve seat or gasket 52 and funnel 32 are located generally on a line extending through the diametrically opposed cutouts 37 and 38, for purposes appearing presently. Also, the gasket surface 52 may be provided with an annular sealing rib 91 for sealing engagement with disc 60.

Upstanding from diametrically opposed regions of disc-like valve element 60, generally in alignment with cutouts 37 and 38, are a pair of opposed valve element mounting arms 97 and 98. The arms 97 and 98 may be generally arcuate, and may assume generally spherical conformations as continuous extensions of the spherical valve element 60. The upper ends of mounting arms 97 and 98 may terminate generally in alignment with diametrically opposed guides 37 and 38, there being respectively provided with aligned radially oppositely outwardly projecting stub shafts or pins 61 and 62. The shafts or pins 61 and 62 extend respectively through cutouts or guides 37 and 38. The stub shaft 61 is provided with a pair of spaced circumferential grooves 63 and 64, as is the stub shaft 62 similarly provided with a pair of spaced circumferential grooves 65 and 66. The grooves 64 and 66 are outwardly of the grooves 63 and 65, respectively, which outer grooves are respectively disposed within guide notches or cutouts 37 and 38, loosely receiving the respective edge margins thereof, as may be seen in FIG. 2. Thus, the cutouts or guide notches 37 and 38 may be seen to constrain the valve element 12 and spherical disc 60 to rotation about the alinged axes of shafts 61 and 62 and to vertical up and down movement.

The outer end of stub shaft 61 may be provided with a transverse extension, crank or arm 70, as for manually actuating rotation of the valve element 60, as between the closed solid line position of FIG. 3 and the open phantom position thereof. The distal end of stub shaft 62 may be provided with a polygonal cross-sectional region 71, say of square cross-section.

As best seen in FIG. 3, the spherical valve element 60 is shown in solid lines seated in sealing, closing relation with the valve seat 52. In this condition the shafts 61 and 62 extend through respective guide notches 37 and 38 with clearance between the under sides of the shafts and the lower regions of the guide notches, so that the valve element 60 is free to move downwardly into sealing engagement with the seat 52.

In order to yieldably maintain this sealing engagement of valve element 60 with seat 52, there are provided resilient means yieldably urging shafts 61 and 62 downwardly, such as a pair of coil tension springs 75 and 76 respectively engaged over and yieldably urging shafts 61 and 62 downwardly. That is, the upper ends of springs 75 and 76 are respectively connected to shafts 61 and 62, and the lower spring ends are connected to the nether regions of adaptor 25 in any suitable manner, such as disclosed in greater detail in said co-pending patent application. Further, by this resilient downward biasing of valve element 60, the insert 46 is urged downwardly to maintain sealing engagement with gasket 57 on top vessel wall 17, all against the upward force of pressurized fluid from within the vessel 16.

When it is desired to open the valve closure 10, say to fill the vessel 15, it is only necessary to turn the crank or handle 70 to rotate the spherical disc or valve element 60 out of its closing relation with valve seat 52, say to the phantom position shown in FIG. 3.

Figure 1:
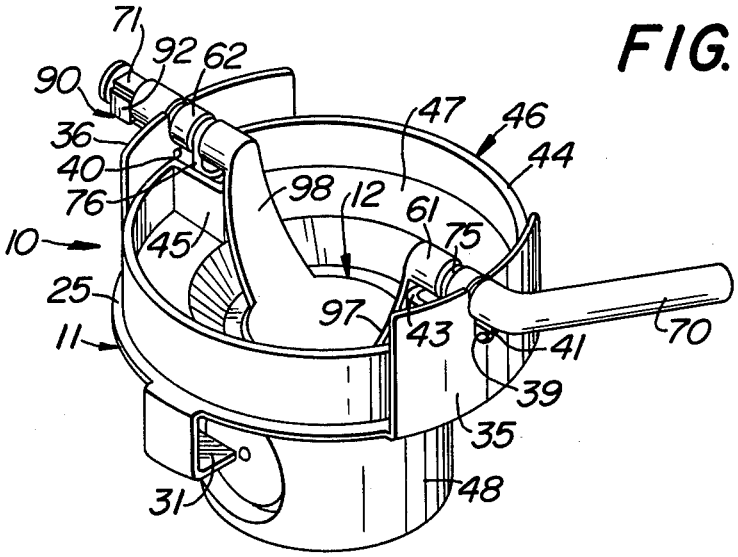
FIG. 1 is a top perspective view showing a valved closure of the present invention apart from an automotive radiator or other pressure vessel.
Figure 2:
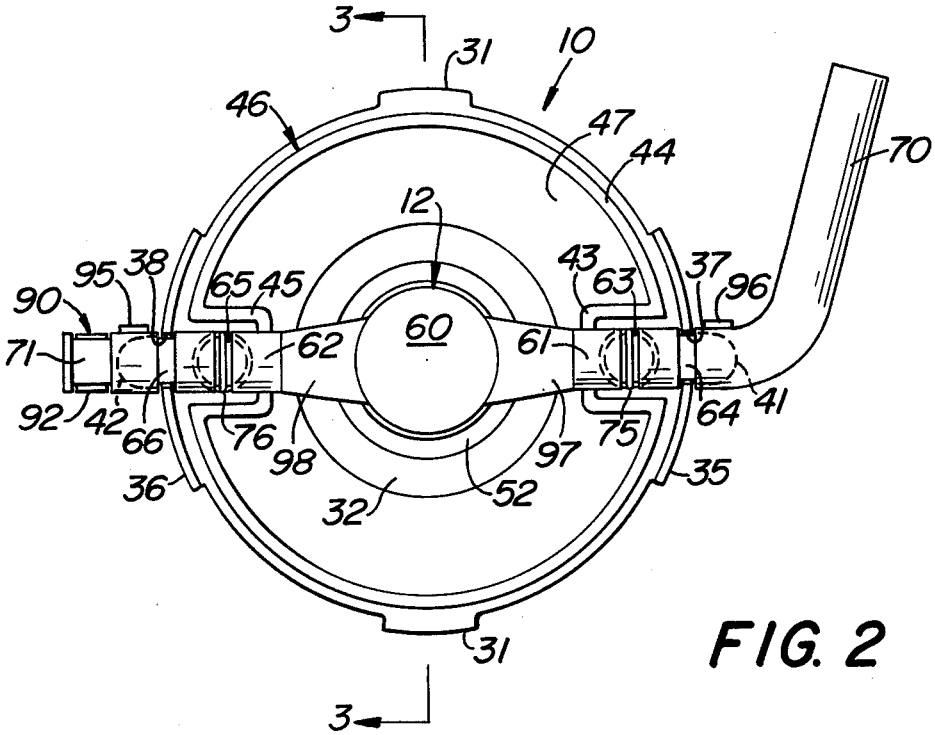
FIG. 2 is a top plan view of the valved closure of FIG. 1.

A leaf spring assembly is generally designated 90, see FIGS. 1 and 2, including a pair of resilient arms or leaves 92, suitably connected to the adjacent nether ledge 42, the leaves being mounted in resiliently yieldably retaining engagement with opposed flats of polygonal shaft portion 71. Thus, the valve element 60 and shafts 61 and 62 are deliberately rotatable between the closed solid line position of FIG. 3, and the open, phantom position, the polygonal shaft portion 71 being yieldably and releasably retained in both of these positions by the leaf assembly 90.

Additionally, the shaft 62 is provided at one location thereon with an external protrusion or cam 95 on one quadrant of the shaft. In the closed position of valve element 60, the cam or protrusion 95 extends laterally or horizontally outwardly however upon rotation of the valve element to its open position the cam 95 swings downwardly into camming engagement with the nether ledge or shelf 42 to gradually raise the valve element 60 and initiate slight venting of pressurized fluid from the vessel 16 prior to opening of the valved closure. A similar cam 96 is provided on shaft 61 for similar cooperation with the ledge 41. In addition to providing gradual, safe venting before rapid opening of the valve 12, this raising of the valve element 60 from the seat 52 reduces wear and the subsequent possibility of leakage.

Thus, it will now be appreciated that the valved closure 10 serves not only to permit selective opening and closing of the vessel 15, but also permits of automatic venting of high and normal pressures through valve 54 while providing for the return of fluid upon normal low pressures. The opposed side walls or shields 35 and 36 serve by their cutouts or guides 37 and 38 to guide rotative and vertical movement of valve element or disc 60, and also to shield both an operator and the engine from a shower of pressurized radiator fluid.

From the foregoing, it is seen that the present invention provides a valved closure which is extremely simple in construction and operation, entirely reliable and durable throughout a long useful life, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. In a pressure vessel, the combination comprising a vessel top wall, a filling neck upstanding from and opening through said top wall and having a fluid passageway intermediate its vertical extent, a flange on said neck, an annular adaptor for removable engagement over and sealing the upper end of the neck in interfitting relation with the flange, a pair of aligned upwardly opening pedestal bearings upstanding from opposite locations on said adaptor, an annular insert in sealing engagement within said adaptor and entering in spaced relation with said neck into sealing engagement with said top wall, said insert and neck combining to define therebetween a chamber communicating exteriorly through said intermediate passageway, an annular upwardly facing concave seat on said insert, a valve element having a convex exterior sealing region engagable in sealing relation with said seat, a pair of aligned shafts extending from opposite sides of said valve element and journaled in respective bearings to rotatively guide said valve element out of and into said sealing relation with said seat, resilient means yieldably retaining said shafts downwardly in said bearings against internal pressure within said vessel to urge said valve element toward said seat, and a pair of oppositely directed one-way valves in said insert for passing fluid at predetermined pressures in one direction from said vessel through said chamber and intermediate passageway and in the other direction through said intermediate passageway and chamber into said vessel.

2. The combination according to claim 1, in combination with cam means on at least one of said shafts for incrementally lifting the latter and said valve element upon initial rotation out of said sealing relation with said seat to gradually vent pressure from said vessel.

3. The combination according to claim 2, said cam means comprising a protuberance on one of said shafts outboard of its pedestal bearing, and an outstanding ledge on said adaptor beneath said one shaft engagable with said protuberance to initiate raising of said valve element.

4. The combination according to claim 1, in combination with an arm extending from one shaft for manual actuation of the latter and a shield upstanding about said one shaft for protection from pressurized fluid discharge.

5. The combination according to claim 1, the resilient means comprising at least one tension spring extending between one of said shafts and said adaptor.

6. The combination according to claim 1, in combination with detent means for releasably holding said valve element in a selected positions of its rotative movement.

7. The combination according to claim 6, said detent means comprising a leaf spring adjacent to and in resilient bearing engagement with one of said shafts, said one shaft having flats for engagement with said leaf spring with said valve element at said positions.

8. The combination according to claim 1, said shafts being spaced above the lower regions of said bearings to assure said valve element is maintained in said sealing relation with said seat by said resilient means.

9. The combination according to claim 1, said seat and valve elements having mating generally spherical curvatures with coincident centers, and said shafts extending generally through said centers of curvature.

* * * * *